US009280169B2

(12) United States Patent
Bouwman et al.

(10) Patent No.: US 9,280,169 B2
(45) Date of Patent: Mar. 8, 2016

(54) VOLTAGE REGULATOR AND A METHOD FOR REDUCING AN INFLUENCE OF A THRESHOLD VOLTAGE VARIATION

(75) Inventors: Jeroen Bouwman, Nijmegen (NL); Leon C. M. van den Oever, Rosmalen (NL)

(73) Assignee: EPCOS AG, Munich (DE)

( * ) Notice: Subject to any disclaimer, the term of this patent is extended or adjusted under 35 U.S.C. 154(b) by 156 days.

(21) Appl. No.: 13/808,527

(22) PCT Filed: Jul. 7, 2010

(86) PCT No.: PCT/EP2010/059743

§ 371 (c)(1),
(2), (4) Date: Mar. 18, 2013

(87) PCT Pub. No.: WO2012/003871

PCT Pub. Date: Jan. 12, 2012

(65) Prior Publication Data

US 2013/0169250 A1 Jul. 4, 2013

(51) Int. Cl.
*G05F 3/16* (2006.01)
*G05F 3/20* (2006.01)

(52) U.S. Cl.
CPC ... *G05F 3/16* (2013.01); *G05F 3/20* (2013.01)

(58) Field of Classification Search
CPC ..... G05F 3/30; G05F 1/56; G05F 1/575; G05F 3/24; H02M 3/1588
USPC ..... 323/265, 271, 273, 274, 312, 313, 315
See application file for complete search history.

(56) References Cited

U.S. PATENT DOCUMENTS

| | | | | |
|---|---|---|---|---|
| 5,793,194 | A | 8/1998 | Lewis | |
| 7,564,230 | B2 * | 7/2009 | Liwinski | 323/280 |
| 8,049,483 | B2 * | 11/2011 | Yamamoto et al. | 323/313 |
| 2007/0159145 | A1 | 7/2007 | Liwinski | |

(Continued)

FOREIGN PATENT DOCUMENTS

| | | | |
|---|---|---|---|
| EP | 0 620 514 | A2 | 10/1994 |
| JP | 2007243688 | A1 | 9/2007 |
| JP | 2009218996 | A | 9/2009 |

(Continued)

OTHER PUBLICATIONS

Basso, T., et al., "A Complementary GaAs Microprocessor for Space Applications," CS Mantech Conference 2007, 12 pages.

(Continued)

*Primary Examiner* — Timothy J Dole
*Assistant Examiner* — Htet Z Kyaw
(74) *Attorney, Agent, or Firm* — Slater & Matsil, L.L.P.

(57) ABSTRACT

A voltage regulator can provide a regulated output voltage. The voltage regulator includes a regulating module that includes a resistor and a field effect transistor that has a threshold voltage. The resistor is coupled to a gate terminal and a source terminal of the field effect transistor. The regulating module provides the output voltage. A reference module is suitable for detecting a variation of the output voltage. The reference module is coupled with the regulating module. A current sink is suitable for subtracting a compensation current from the current flowing from the regulating module to the reference module. The compensation current is dependent on a variation of the threshold voltage.

12 Claims, 11 Drawing Sheets

(56) References Cited

U.S. PATENT DOCUMENTS

| | | | | |
|---|---|---|---|---|
| 2008/0074176 | A1 | 3/2008 | Yamamoto | |
| 2010/0246219 | A1 * | 9/2010 | Ying et al. | 363/74 |

FOREIGN PATENT DOCUMENTS

| | | | |
|---|---|---|---|
| JP | 2010124408 | A | 6/2010 |
| JP | 2011160256 | A | 8/2011 |
| JP | 2012060550 | A | 3/2012 |
| JP | 2012508973 | A | 4/2012 |

OTHER PUBLICATIONS

Dai, Y., et al., "A GaAs HBT bandgap voltage reference," International Journal of Electronics, vol. 92, No. 2, Feb. 2, 2005, pp. 87-97.

De Hek, A.P., et al., "On-chip active gate bias circuit for MMIC amplifier applications with 100% threshold voltage variation compensation," Proceedings of the 1st European Microwave Integrated Circuits Conference, Sep. 1, 2006, pp. 525-528.

Henderson, T., et al., "High-Performance BiHEMT HBT / E-D pHEMT Integration," CS Mantech Conference 2007, 4 pages.

Lin, C.K., et al., "Monolithic Integration of E/Dmode pHEMT and InGaP HBT Technology on 150-mm GaAs Wafers," CS Mantech Conference 2007, 4 pages.

Peatman, W., et al., "InGaP-Plus™: Advanced GaAs BiFET Technology and Applications," CS Mantech Conference 2007, 4 pages.

Ramanathan, R., et al., "Commercial Viability of a Merged HBT-FET (BiFET) Technology for GaAs Power Amplifiers," CS Mantech Conference 2007, 5 pages.

* cited by examiner

VOLTAGE REGULATOR AND A METHOD FOR REDUCING AN INFLUENCE OF A THRESHOLD VOLTAGE VARIATION

This patent application is a national phase filing under section 371 of PCT/EP2010/059743, filed Jul. 7, 2010, which is incorporated herein by reference in its entirety.

TECHNICAL FIELD

The invention concerns a voltage regulator which comprises a field effect transistor and a method for reducing an influence of a threshold voltage variation of a field effect transistor.

BACKGROUND

A voltage regulator which provides a regulated voltage may be a block in a circuit design. The voltage regulator may be part of an RF power amplifier. For instance for an RF power amplifier design the regulated voltage may be constant over supply voltage variation, have less temperature dependency, and have less dependency on load current. Further, the regulated voltage should be insensitive to process spread which may cause, e.g., a threshold voltage variation or a sheet resistance variation.

In GaAs (BiFET) technology it is difficult to design a voltage regulator with these properties, which is realized with minimum layout size, minimum current consumption, in on-state as well as in off-state, and low noise. Merged or stacked FET-HBT integration schemes, often called BiFET or BiHEMT and containing both HBT and FET or pHEMT devices on a single GaAs substrate, are reported in the following papers from the CS MANTECH Conference 2007: William Peatman, Mohsen Shokrani, Boris Gedzberg, Wojciech Krystek, and Michael Trippe: "InGaP-Plus™: Advanced GaAs BiFET Technology and Applications;" T. Henderson, J. Middleton, J. Mahoney, S. Varma, T. Rivers, C. Jordan, and B. Avrit: "High-Performance BiHEMT HBT/E-D pHEMT Integration;" Todd D. Basso and Richard B. Brown: "A Complementary GaAs Microprocessor for Space Applications;" Ravi Ramanathan, Mike Sun, Peter J. Zampardi, Andre G. Metzger, Vincent Ho, Cejun Wei, Peter Tran, Hongxiao Shao, Nick Cheng, Cristian Cismaru, Jiang Li, Shiaw Chang, Phil Thompson, Mark Kuhlman, Kenneth Weller: "Commercial Viability of a Merged HBT-FET (BiFET) Technology for GaAs Power Amplifiers;" C. K. Lin, T. C. Tsai, S. L. Yu, C. C. Chang, Y. T. Cho, J. C. Yuan, C. P. Ho, T. Y. Chou, J. H. Huang, M. C. Tu, and Y. C. Wang: "Monolithic Integration of E/D-mode pHEMT and InGaP HBT Technology on 150-mm GaAs Wafers."

U.S. Patent Publication 2007/0159145 shows a voltage regulator in GaAs (BiFET) technology whose characteristics may vary with process spread, in particular the threshold voltage may vary.

Process spread variation, in particular threshold voltage spread, can be less of a problem if the process is within tight limits and monitored and controlled. But usually this is not enough, therefore process steering might be used which can affect other parameters and involve extra cost.

In the case of manufacturing a GaAs pHEMT the threshold voltage depends on the gate recess etching and on the epi starting material. The gate recess etching is extremely critical because it concerns nanometer scale accuracy, and process spread is therefore unavoidable. The epi starting material in GaAs technology often comes from an external supplier, so that the loop for epi process control is too long. Further, batch-to-batch variation can be large compared to wafer-to-wafer or on-wafer variation.

Yihong Dai, Donald T. Corner and David J. Corner: "A GaAs HBT bandgap voltage reference," International Journal of Electronics, Vol. 92, No. 2, February 2005, pages 87-97, shows a complex circuit, among others a bandgap referenced voltage regulator circuit, which cannot meet all of the beforementioned requirements, especially size, current consumption, noise performance, sensitivity for load-variations, etc., at the same time.

Another alternative is an externally supplied reference voltage. Although it might be possible to generate the regulator voltage in another part of the system, for power amplifiers the trend is to eliminate the external reference voltage.

SUMMARY OF THE INVENTION

A threshold voltage variation may be caused by process spread. In one aspect, the invention provides a voltage regulator that is less sensitive to threshold voltage variation.

An embodiment voltage regulator is suitable for providing a regulated output voltage and comprises a regulating module comprising a resistor and a field effect transistor which has a threshold voltage. The resistor is coupled to a gate terminal and a source terminal of the field effect transistor. The regulating module provides the output voltage. The voltage regulator further comprises a reference module which is suitable for detecting a variation of the output voltage. The reference module is coupled with the regulating module. The voltage regulator further comprises a current sink suitable for subtracting a compensation current from the current flowing from the regulating module to the reference module. The compensation current is dependent on a variation of the threshold voltage.

Output voltage variation as a result of the threshold voltage variation is eliminated or reduced by means of the current sink which serves as compensation circuit.

In one embodiment the regulating module is suitable for regulating a current flowing through the resistor. The voltage drop across the resistor depends on the current which flows through the transistor. The voltage drop correlates with the gate-source voltage of the field effect transistor, which controls the current through the field effect transistor and the resistor. The resistor and the field effect transistor form a loop which regulates the current.

In one embodiment the reference module is adapted so that a reference current through the reference module changes in response to the variation of the output voltage. The reference current correlates with the current that flows through the resistor of the regulating module, which influences the voltage drop across the resistor, thereby regulating the output voltage which is provided at the source terminal of the field effect transistor.

In one embodiment the reference module comprises a transistor having a base terminal with the output voltage. The improved voltage regulator provides a slightly higher output voltage. The extra voltage headroom offers advantages for the trade-off between transistor size, current consumption and temperature behavior, which means that the output voltage in dependence on the temperature is constant or has only a small positive or negative slope.

In one embodiment the current sink is suitable for subtracting the compensation current which is within a range from nearly zero to a maximum current value. This current sink is suitable for compensating a wide range of the threshold voltage variation.

In one embodiment the current sink comprises a circuit that draws a compensation current that "tracks" the deviation of the threshold voltage. The circuit comprises a reference pHEMT to detect the threshold voltage, and transistors and resistors to generate the required compensation current. In one embodiment the current sink comprises a current mirror to form a current source output. The compensation current drawn by the current sink applies a correction, so that the current through the reference module and output voltage becomes insensitive to the threshold voltage variation.

In one embodiment the field effect transistor is a pHEMT, as for example formed in GaAs technology.

The voltage regulator may be coupled to an enabling module for activating the voltage regulator, wherein the enabling module is coupled between the voltage regulator and a supply voltage terminal. The enabling module is suitable for switching on and off the voltage regulator. It does not affect the on-state behavior, and has very low off-state leakage current.

In one embodiment the current sink comprises a transistor serving as a switch, which avoids or reduces leakage current in off-state.

One embodiment comprises the voltage regulator and a bias circuit. The voltage regulator provides an output voltage which allows the insertion of additional resistors for improved RF isolation between the voltage regulator and the bias circuit. This improves the RF isolation, or can be used to implement a programmable bias current. For this purpose the bias circuit comprises a multitude of series connections each comprising a resistor and a switch, wherein the series connections are connected in parallel. Further the voltage regulator and bias circuit can be switched on and off. This bias circuit has a very low current consumption in off-state.

A method for reducing the influence of a threshold voltage variation of a field effect transistor is provided, wherein a regulating module comprises the field effect transistor and a resistor being coupled to a gate terminal and a source terminal of the field effect transistor. The method comprises adjusting a voltage drop over the resistor, thereby compensating the influence of the variation of the threshold voltage.

The voltage drop may be adjusted by the current flowing through the resistor, thereby changing the voltage drop across the resistor which is correlated with the gate-source voltage of the field effect transistor.

The method may further comprise detecting the threshold voltage and subtracting a compensation current which is dependent on the threshold voltage from the current, thereby providing a regulated reference current.

BRIEF DESCRIPTION OF THE DRAWINGS

Further features and refinements become apparent from the following description of the exemplary embodiments in connection with the accompanying figures.

DETAILED DESCRIPTION OF ILLUSTRATIVE EMBODIMENTS

Figure 1:
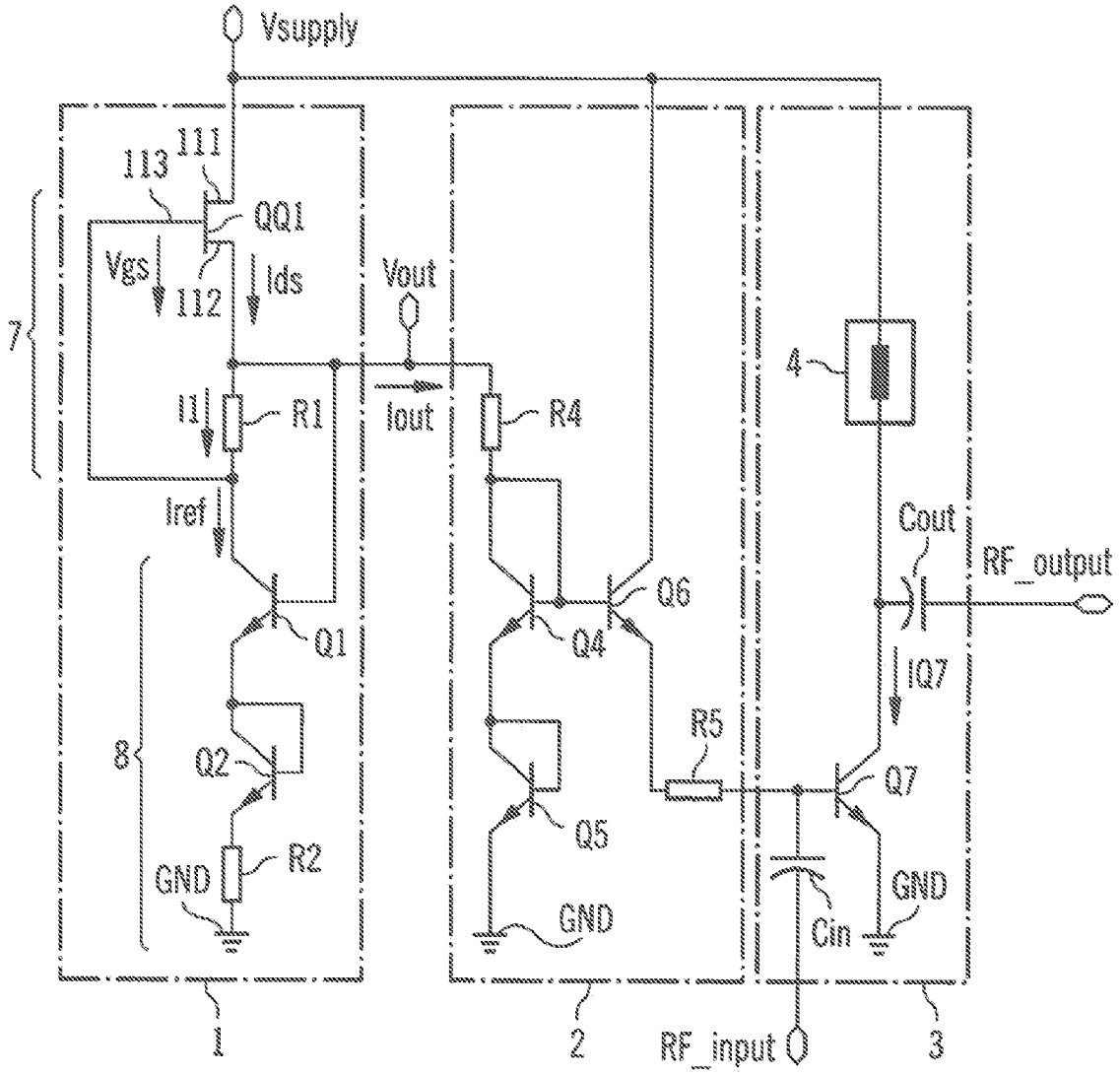
FIG. 1 shows an embodiment of an RF power amplifier circuit comprising an embodiment of a voltage regulator, an embodiment of a bias circuit and an embodiment of an RF power stage.

FIG. 1 shows an embodiment of an RF power amplifier circuit comprising a voltage regulator 1, a bias circuit 2 and an RF power stage 3.

The voltage regulator 1 provides a regulated output voltage Vout which is used to bias the RF power stage 3. The voltage regulator 1 comprises a pHEMT QQ1, which is an embodiment of a field effect transistor, having a drain terminal 111, a source terminal 112 and a gate terminal 113. A first resistor R1 is coupled with the source terminal 112 and the gate terminal 113 of the pHEMT QQ1. The output voltage Vout is provided at the source terminal 112 of the pHEMT QQ1.

A first transistor Q1 is coupled downstream from the first resistor R1, wherein a collector terminal of the first transistor Q1 is coupled with the first resistor R1. The output voltage Vout is at a base terminal of the first transistor Q1. An emitter terminal of the first transistor Q1 is coupled with a collector terminal and a base terminal of a second transistor Q2. The second transistor Q2 is a diode-connected transistor. A second resistor R2 is coupled between an emitter terminal of the second transistor Q2 and a reference potential GND. The second resistor R2 is optional and is used to increase the output voltage Vout and to adjust the temperature behavior.

The bias circuit 2 shown on FIG. 1 is an exemplary embodiment. It comprises a fourth resistor R4, a fourth transistor Q4 and a fifth transistor Q5 which are coupled in series, wherein a base terminal and a collector terminal of the fourth transistor Q4 are connected, as well as a base terminal and a collector terminal of the fifth transistor Q5 are connected. The output voltage Vout is applied to the series connection R4, Q4, Q5. Further, the bias circuit 2 comprises a sixth transistor Q6 and a fifth resistor R5. The supply potential Vsupply is applied to a collector terminal of the sixth transistor Q6. An emitter terminal of the sixth transistor Q6 is coupled with the fifth resistor R5. A base terminal of the sixth transistor Q6 is coupled with the base terminal of the fourth transistor Q4.

The RF power stage 3 comprises an RF choke 4 and a seventh transistor Q7, wherein the RF choke 4 is coupled between the supply potential Vsupply and a collector terminal of the seventh transistor Q7, whose emitter terminal is coupled with the reference potential GND. A base terminal of the seventh transistor Q7 is connected with the fifth resistor R5 of the bias circuit 2.

An input potential RF_input is applied to a base terminal of the seventh transistor Q7 via an input capacitor Cin. The output potential RF_output is provided at an output capacitor Cout which is coupled with the collector terminal of the seventh transistor Q7.

The voltage regulator 1 provides the regulated output voltage Vout which then gives a constant or regulated bias current IQ7 in the seventh transistor Q7 of the RF power stage 3.

The voltage regulator in FIG. 1 is improved with respect to a conventional circuit. The diode level shift in the emitter of the first transistor Q1 instead of in, e.g., the base of a transistor, results in a higher output voltage Vout, which gives voltage headroom for the fourth resistor R4 and a better trade-off between bias, temperature behavior, and RF isolation.

The current through the pHEMT QQ1 is kept constant by a first control loop comprising the pHEMT QQ1 and the first resistor R1. The output voltage Vout is kept constant (even under load and supply voltage variations) by a second control loop formed by the first transistor Q1, the first resistor R1 and the pHEMT QQ1.

The pHEMT QQ1 and the first resistor R1 serve as regulating module 7, which provides the output voltage Vout and regulates a constant current I1 flowing through the first resistor R1. The circuit operates as follows. The output voltage Vout typically decreases for an increasing load current Iout. Then the current I1 through R1 and a voltage drop across R1 decrease and the gate-source voltage Vgs of the pHEMT QQ1 becomes less negative which causes the pHEMT QQ1 to give more current Ids to the load and through R1, such that the current I1 through the first resistor R1 reaches a nominal designed value.

The connection of the first transistor Q1, the second transistor Q2 and the second resistor R2 serves as a reference module 8 which detects a variation of the output voltage Vout. During normal operation a reference current Iref flows through the connection Q1, Q2, R2, thereby a voltage drops across the first transistor Q1, the second transistor Q2 and the second resistor R2 which is equal to the desired output voltage Vout. If the output voltage Vout increases, a base current and the collector current Iref of the first transistor Q1 increases. Higher collector current Iref results in higher current I1 through the first resistor R1 and a higher voltage drop across the first resistor R1, which results in a more negative gate-source voltage of the pHEMT QQ1 and a lower drain-source current Ids through the pHEMT QQ1, and subsequent reducing Vout. If the output voltage Vout decreases, the voltage across the base-emitter-junction of the first transistor Q1 and second transistors Q2 and the second resistor R2 decreases. Due to this decrease in the voltage across the base-emitter junction of the first transistor Q1 the collector current Iref decreases, thereby the voltage drop across the first resistor R1 decreases, which makes the gate-source voltage Vgs of the pHEMT QQ1 less negative, thereby increasing the current Ids through the pHEMT QQ1. The increase of the current Ids results in higher current Iref through reference module 8 and increases the output voltage Vout. In this way the loop reaches the designed value.

Figure 2:
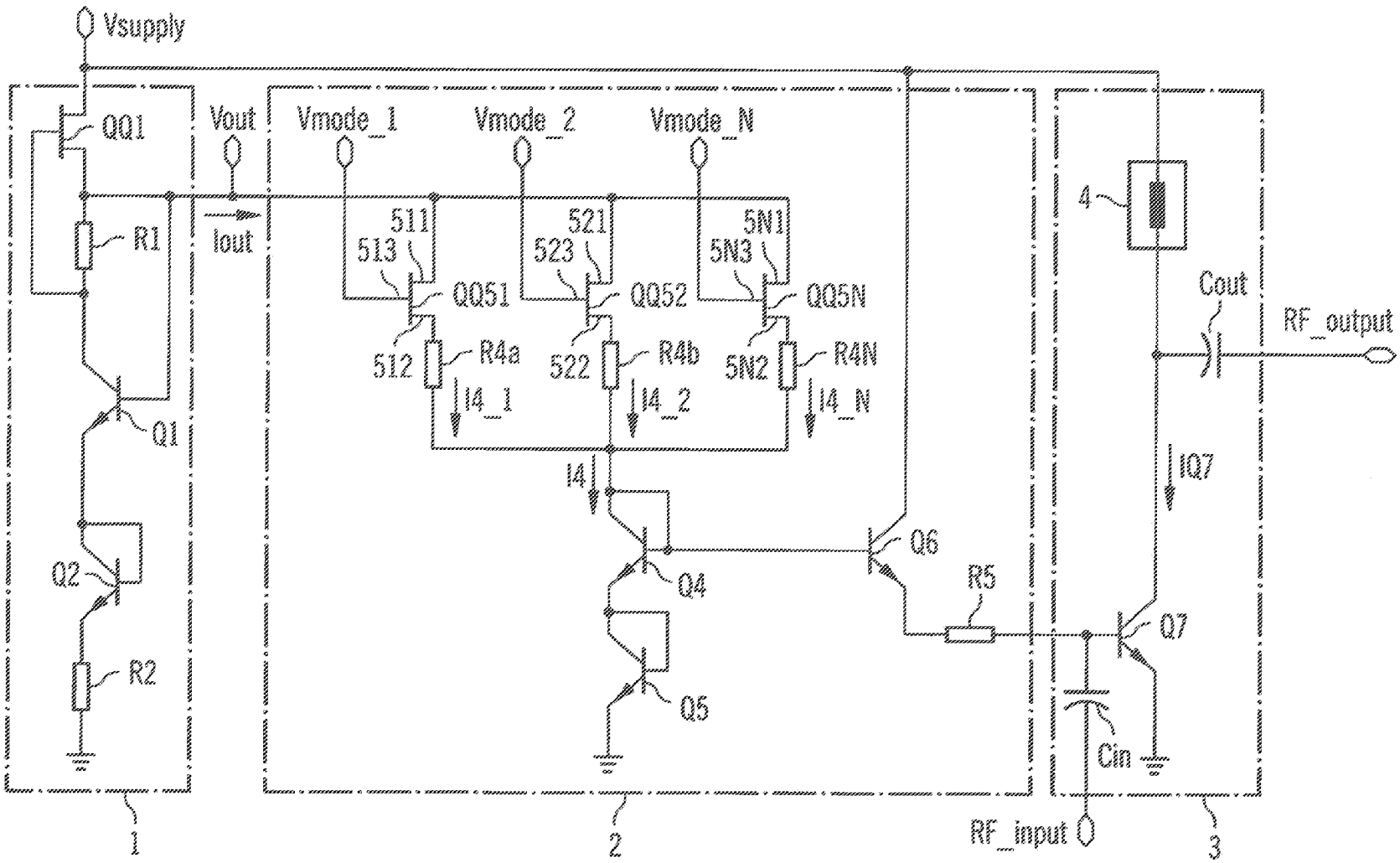
FIG. 2 shows an embodiment of an RF power amplifier circuit with a bias circuit where the bias current is programmable.

FIG. 2 shows a further embodiment of an RF power amplifier circuit comprising the voltage regulator 1 and the RF power stage 3 both as shown in FIG. 1. An embodiment of the bias circuit 2 shown in FIG. 2 is suitable for programming a current.

With the additional voltage headroom, it is also possible to insert multiple resistors R4*a*, R4*b*, R4N that can be switched into the bias circuit 2 so that the bias current IQ7 can be programmed by mode switches. The bias circuit 2 in FIG. 2 shows a multitude of resistors R4*a*, R4*b*, R4N instead of the single fourth resistor R4 shown in FIG. 1. Further, a multitude of switches embodied as pHEMTs QQ51, QQ52, QQ5N is provided. In this embodiment three pHEMTs QQ51, QQ52, QQ5N and three resistors R4*a*, R4*b*, R4N are exemplary shown. It is possible to provide less switches and resistors. The resistance of the resistors R4*a*, R4*b*, R4N may be the same or be different.

The output potential Vout of the voltage regulator 1 is applied to drain terminals 511, 521, 5N1 of the pHEMTs QQ51, QQ52, QQ5N. A source terminal 512, 522, 5N2 of each pHEMT QQ51, QQ52, QQ5N is coupled of one terminal of one resistor R4*a*, R4*b*, R4N of the multitude of resistors R4*a*, R4*b*, R4N. The other terminals of the resistors R4*a*, R4*b*, R4N are coupled with the collector terminal of the fourth transistor Q4. The pHEMTs QQ51, QQ52, QQ5N can be switched by applying switching voltages Vmode_1, Vmode_2, Vmode_N which control the pHEMTs QQ51, QQ52, QQ5N and switch the resistors R4*a*, R4*b*, R4N. The current I4 is then determined by the resistance of the resistors R4*a*, R4*b*, R4N and the resistance of the pHEMTs QQ51, QQ52, QQ5N which operates in the linear region, for the different parallel branches. The order of the PHEMTs QQ51, QQ52, QQ5N and resistors R4*a*, R4*b*, R4N can also be reversed.

FIGS. 3A, 3B, 3C, 3D, 3E show five other embodiments of the voltage regulator 1 differing from the voltage regulator shown in FIG. 1 in which only the first transistor Q1 is within the control loop, the second transistor Q2 being merely a level shift diode. The circuits shown in FIGS. 3A-E have both transistors Q1 and Q2 in the control loop. Further, for FIGS. 3B, 3C, 3D and 3E, the third transistor Q3 is Vbe-mirrored with the second transistor Q2. Their sizes can be equal or different. The embodiments shown in FIGS. 3A, 3B, 3C, 3D, 3E may look quite similar but behave slightly differently over temperature and supply voltage variation.

Figure 3A:
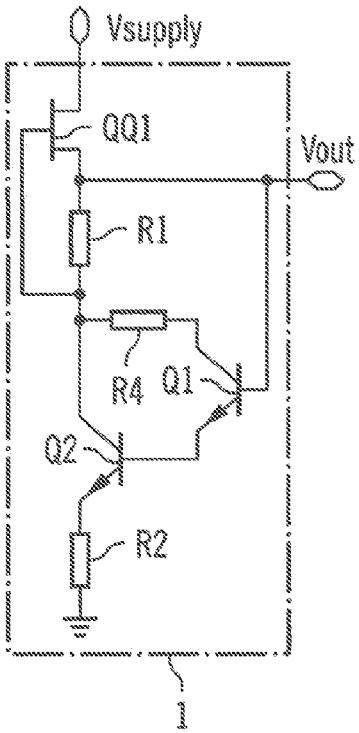
FIGS. 3A, 3B, 3C, 3D and 3E show further embodiments of the voltage regulator.

In FIG. 3A the transistors Q1 and Q2 form a Darlington pair.

Figure 3B:
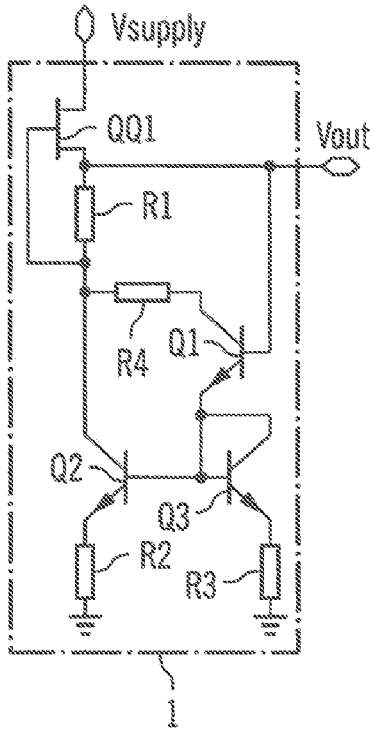

FIG. 3B is similar to FIG. 3A, but has an extra Vbe-mirrored transistor Q3 and a resistor R3 that acts as a current-bleeder. The bias current scales depend on the sizing of the transistors Q2 and Q3, but the current through the first resistor R1 is the same. The behavior over voltage and temperature remains nearly unchanged. This is very useful for practical work where the exact bias current can be set by trimming of bleeder transistors.

Figure 3C:
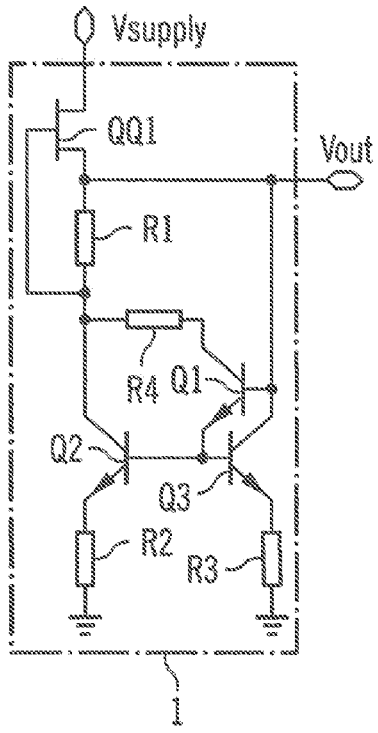

In FIG. 3C the bleeder current comes from the pHEMT QQ1, not through the first resistor R1, and depends on the sizing of the transistors Q2 and Q3.

Figure 3D:
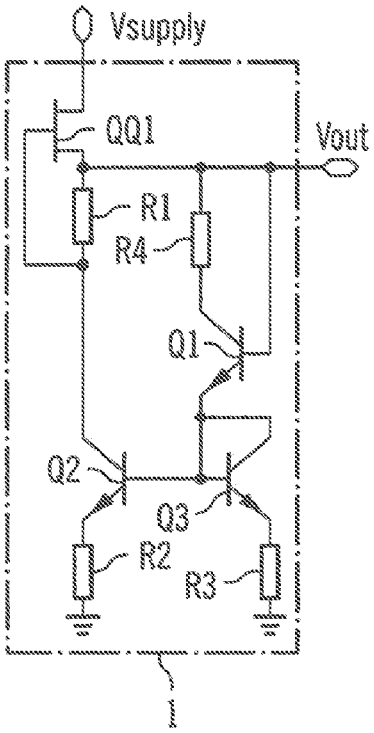

FIG. 3D shows two branches that are coupled via a Vbe-mirror. The currents, the output voltage Vout and the temperature behavior are set by the sizing of the transistors Q2 and Q3.

Figure 3E:
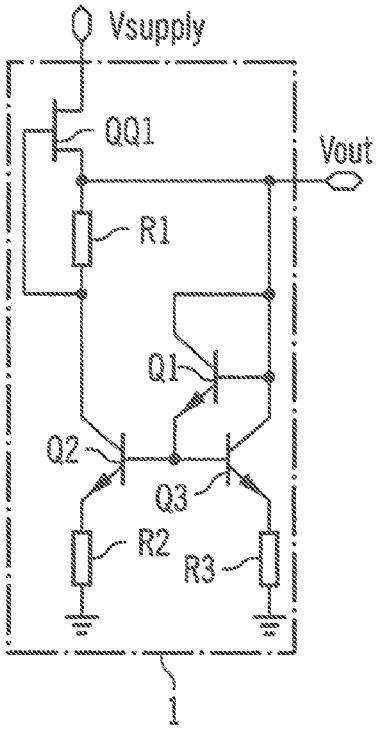

In FIG. 3E the bleeder current again comes from the pHEMT QQ1, not through the first resistor R1. The output voltage Vout depends on the sizing of the transistors Q2 and Q3.

In FIGS. 3A, 3B, 3C and 3D the transistor Q1 works as a transistor, whereas in FIG. 3E the transistor Q1 is connected as a level shift diode.

The resistor R4 in FIGS. 3A, 3B, 3C and 3D can be used to change the operating point of the transistor Q1 from forward operation towards saturation which influences the behavior versus temperature. This enables fine-tuning.

Figure 4A:
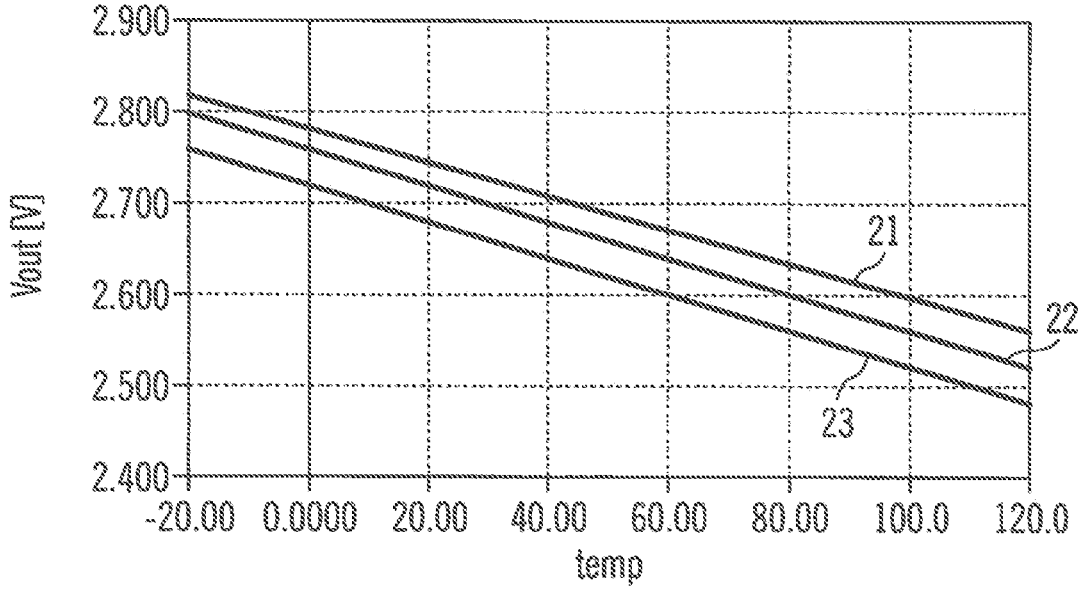
FIGS. 4A and 4B show the behavior of the circuit in FIG. 1 versus temperature, supply voltage variation and threshold voltage variation.
Figure 4B:
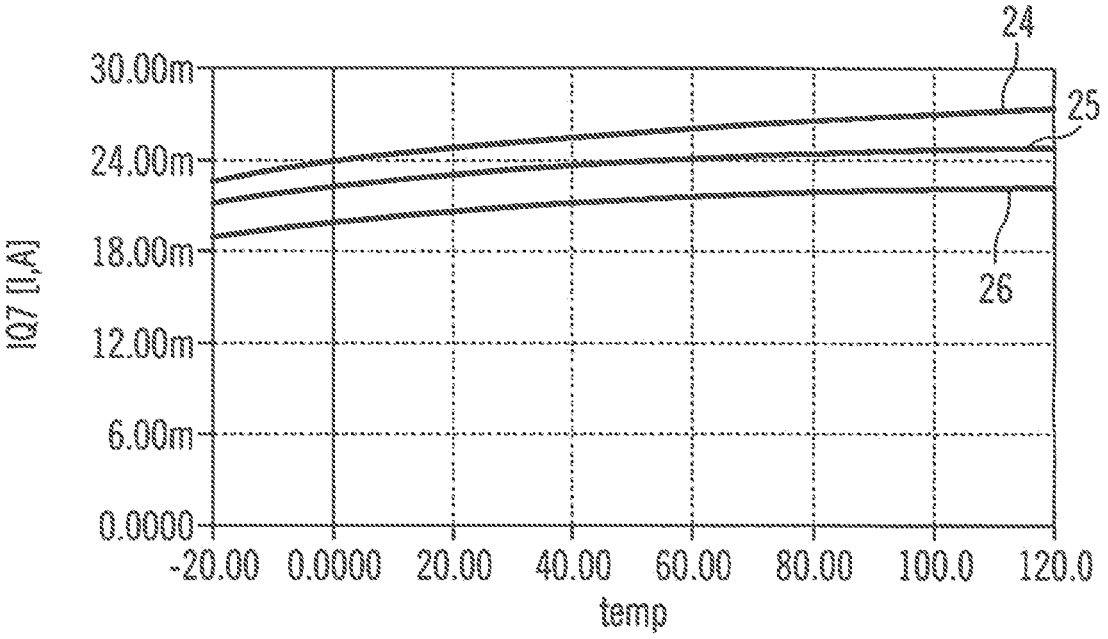

FIG. 4A and FIG. 4B show the behavior of the circuit shown in FIG. 1 versus temperature, wherein the supply voltage and the threshold voltage are varied. The results are simulated.

FIG. 4A shows the output voltage Vout of the circuit shown in FIG. 1 versus temperature. A bunch of curves 21, which looks like a single curve, shows the output voltage Vout in dependence on the temperature in Celsius. Each curve represents one of the supply voltages Vsupply=3.2V, 3.7V, 4.2V, wherein the threshold voltage variation is DVT=−0.5V, which means that the threshold voltage is −0.5V lower than the nominal value VT0. In other words, the curves for the supply voltage variations are on top of each other, thereby looking like a single curve, which means that the voltage regulator 1 is hardly sensitive to the supply voltage variation. The bunch of curves 22 which looks like a single curve shows the output voltage Vout in dependence on the temperature. Each curve represents one of the supply voltages Vsupply=3.2V, 3.7V, 4.2V without threshold voltage variation. In other words, DVT=0V, which means that the threshold voltage is equal to the nominal value VT0. A bunch of curves 23 which looks like a single curve shows the output voltage Vout in dependence on the temperature. Each curve represents one of the supply voltages Vsupply=3.2V, 3.7V, 4.2V, wherein the threshold voltage variation is DVT=0.5V, which means that the threshold voltage is 0.5V higher than the nominal value VT0.

Although the voltage regulator 1 is hardly sensitive to the supply voltage variation, the threshold voltage variation DVT has a significant effect as indicated by the offsets between the bunches of curves 21, 22, 23.

FIG. 4B shows the bias current IQ7 of the RF power stage 3 of the circuit shown in FIG. 1 in dependence on the temperature. A bunch of curves 24 which looks like a single curve shows the bias current IQ7 in dependence on the temperature in Celsius. Each curve represents one of the supply voltages Vsupply=3.2V, 3.7V, 4.2V, wherein the threshold voltage variation is DVT=−0.5V. This means that the voltage regulator 1 is hardly sensitive to the supply voltage variation. A bunch of curves 25 which looks like a single curve shows the bias current IQ7 in dependence on the temperature. Each curve represents one of the supply voltages Vsupply=3.2V, 3.7V, 4.2V, without threshold voltage variation, DVT=0V. A bunch of curves 26 which looks like a single curve shows the bias current IQ7 in dependence on the temperature. Each curve represents one of the supply voltages Vsupply=3.2V, 3.7V, 4.2V, wherein the threshold voltage variation is DVT=0.5V.

The bias current IQ7 is hardly sensitive to the supply voltage variation, but the threshold voltage variation DVT has a significant effect on the bias current IQ7 as indicated by the offsets between the bunches of curves 24, 25, 26.

The current variation due to the threshold voltage variation may be too much for applications such as linear power amplifiers where current setting may be critical.

In practical design a quiescent current for a linear RF power amplifier should be dimensioned such that the RF power amplifier still operates linearly when the process is at the corners. Consequently, without threshold voltage compensation the currents for the nominal process must be set higher than needed, but with threshold voltage compensation this is not necessary. Thus, the following threshold voltage compensation yields lower current consumption.

It should be mentioned that the absolute values for currents and components on which the simulations are based illustrate the effects. Of course, they can be scaled or chosen differently.

The following embodiments show how to reduce the observed threshold voltage variation while maintaining performance and compact realization.

Figure 5:
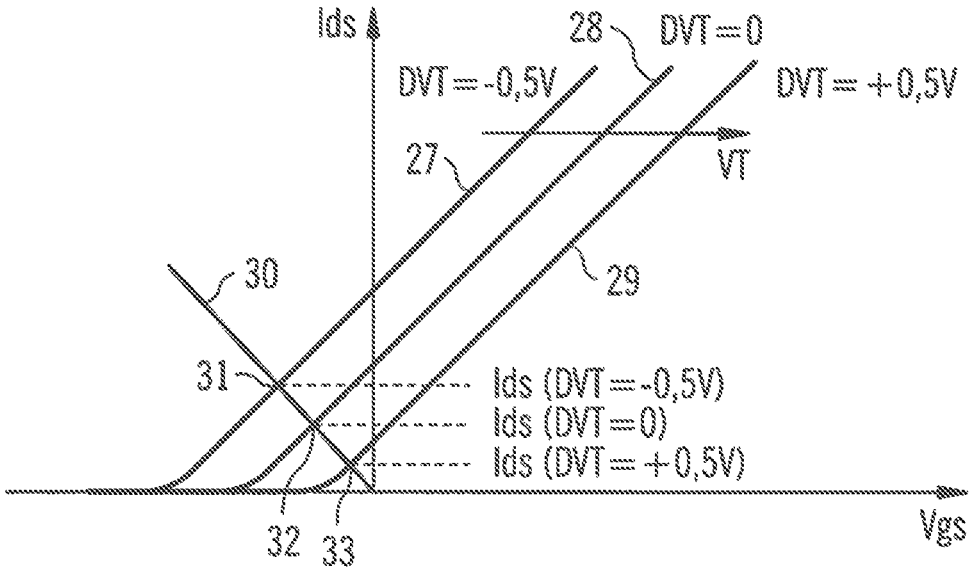
FIG. 5 shows the influence of the threshold voltage variation on an embodiment of a pHEMT.

The principle of operation for the current in the voltage regulator 1 shown in FIG. 1 is illustrated in FIG. 5 which shows the graphical derivation of the bias point of the voltage regulator 1. The drain-source current Ids of the pHEMT QQ1 and the gate-source voltage Vgs of the pHEMT QQ1 are coupled in a feedback loop using the first resistor R1.

FIG. 5 shows the drain-source current Ids of the pHEMT QQ1 in dependence on the gate-source voltage Vgs of the pHEMT QQ1. The curves 27, 28, and 29 show Ids versus Vgs in dependence on the threshold voltage variation DVT. The curve 27 shows Ids versus Vgs wherein the threshold voltage variation is DVT=−0.5, which means the threshold voltage VT differs from the nominal threshold voltage VT0 by DVT=VT−VT0=−0.5V. The curve 28 shows Ids versus Vgs wherein the threshold voltage variation is DVT=0. The curve 29 shows Ids versus Vgs wherein the threshold voltage deviation is DVT=0.5V. Increasing the threshold voltage VT=VT0+DVT shifts the Ids-versus-Vgs curve to the right. In other words, the drain-source current Ids decreases if the threshold voltage VT=VT0+DVT increases while the gate-source voltage Vgs remains constant.

The bias point follows from the device equations which are approximations for operation in the saturation region:

$$Ids=g_m,sat*(Vgs-VT), \tag{1}$$

$$Vgs=-Ids*R1, \tag{2}$$

$$Ids=(g_m,sat*(-VT))/(1+g_m,sat*R1). \tag{3}$$

g_m,sat is the transconductance in saturation. The equation (3) also shows that Ids is proportional to VT, and thus always relative to the threshold voltage variation DVT.

The voltage drop over the first resistor R1 corresponds to the gate-source voltage Vgs that controls the drain-source current Ids of the pHEMT QQ1. A curve 30 indicates the current through the first resistor R1 in dependence on the gate-source voltage Vgs, wherein Vgs=−Ids R1.

The bias points 31, 32, 33 which indicate the drain-source current Ids and the gain-source voltage Vgs during operation are the intersection points 31, 32, 33 between the curve 30 and the curves 27, 28, 29 for DVT−0.5, 0, 0.5V respectively. FIG. 5 shows that the threshold voltage variation DVT causes the variation of the bias points 31, 32, and 33 of the voltage regulator 1.

Figure 6A:
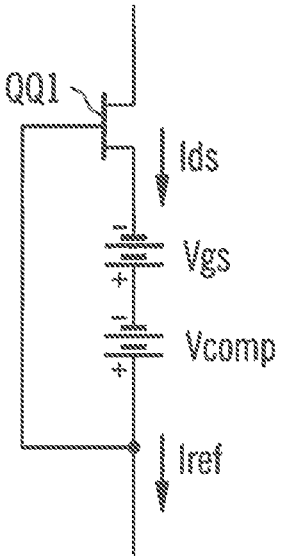
FIGS. 6A and 6B show the principle of a threshold voltage variation compensation.
Figure 6B:
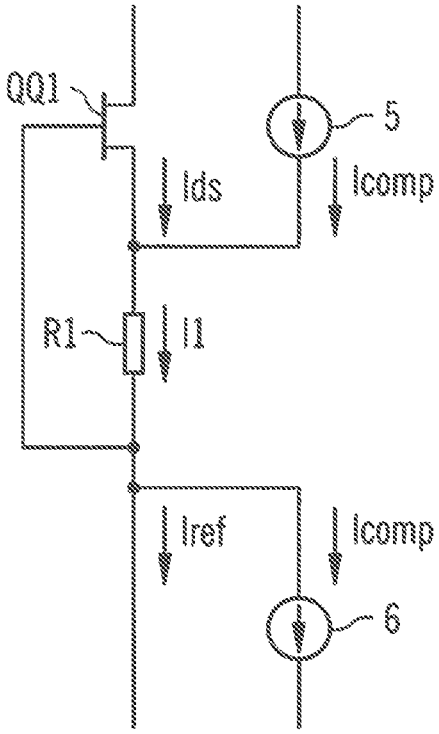

FIGS. 6A and 6B show the principle of the new threshold voltage variation compensation.

The threshold voltage variation is a device spread, but can be compensated in the circuit by a compensation voltage Vcomp in series with the gate-source voltage Vgs, as shown in FIG. 6A. The compensation voltage Vcomp shifts the bias point of the pHEMT QQ1, so that the drain-source current Ids is equal to the drain-source current Ids of a pHEMT QQ1 without threshold voltage variation.

By means of the resistor R1 the compensation voltage Vcomp can be translated into a compensation current Icomp, as illustrated in FIG. 6B. Instead of a voltage source Vcomp the resistor R1 over which a voltage drops may be used to provide the gate-source voltage Vgs and the compensation voltage Vcomp. The voltage drop depends on the current I1 flowing through the resistor R1. The current I1 may differ from the drain-source current Ids. A compensation current Icomp is coupled in at the upstream side of the resistor R1. The in-coupled compensation current Icomp is provided by a current source 5. A compensation current Icomp is coupled out at the downstream side of the resistor R1. The out-coupled compensation current Icomp flows into a current sink 6.

The voltage drop across the resistor R1 may be varied by changing the current I1 that flows through the resistor R1. The current I1 through the resistor R1 is varied independent from the drain-source current Ids by coupling compensation current Icomp in and out. Thereby, the voltage drop over the resistor R1 is varied without influencing the other parts of the circuit by the compensation current Icomp.

The current source 5 and current sink 6 can be left out when its function is already performed by the circuit. For the voltage regulator the upper current source 5 can be left out, because there is a second feedback loop that controls Iref which flows into the reference module 8 independent of the load current. Thus the upper compensation current Icomp is supplied by the pHEMT QQ1 as if it were part of the load current (not shown in FIGS. 6A and 6B).

Thus, the problem of threshold voltage variation is reduced to the design of a proper compensation current sink 6 for subtracting the compensation current Icomp.

Figure 7:
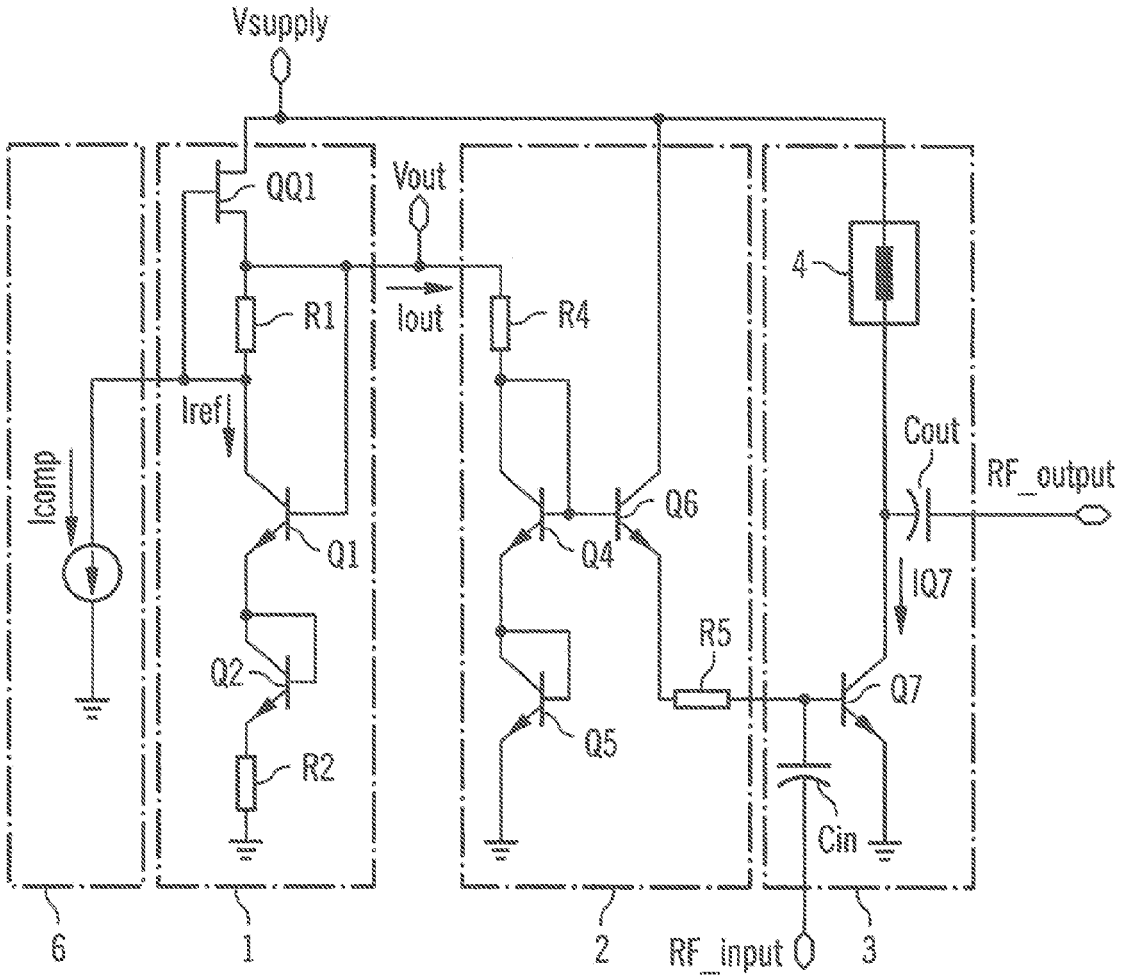
FIG. 7 shows an embodiment of an RF power amplifier circuit comprising an embodiment of the voltage regulator having an ideal current sink.

FIG. 7 shows an embodiment of an RF power amplifier circuit comprising an embodiment of the voltage regulator 1 with a threshold voltage variation compensation by means of an ideal current sink 6. The bias circuit 2 and the RF power stage 3 are also shown.

The voltage regulator 1 is coupled to an ideal compensation current sink 6. The compensation current Icomp needs to be larger for negative threshold voltage variation DVT, which means that the threshold voltage VT is more negative than the nominal threshold voltage value VT0. The compensation current Icomp needs to be smaller for positive threshold voltage variation DVT, which means that the threshold voltage VT is less negative than the nominal threshold voltage value VT0. The compensation circuit 6 needs to be dimensioned such that the compensation current Icomp is zero or small for the highest threshold voltage VT, which means less negative threshold voltage VT. And logically the compensation current Icomp increases for more negative threshold voltage VT.

Figure 8:
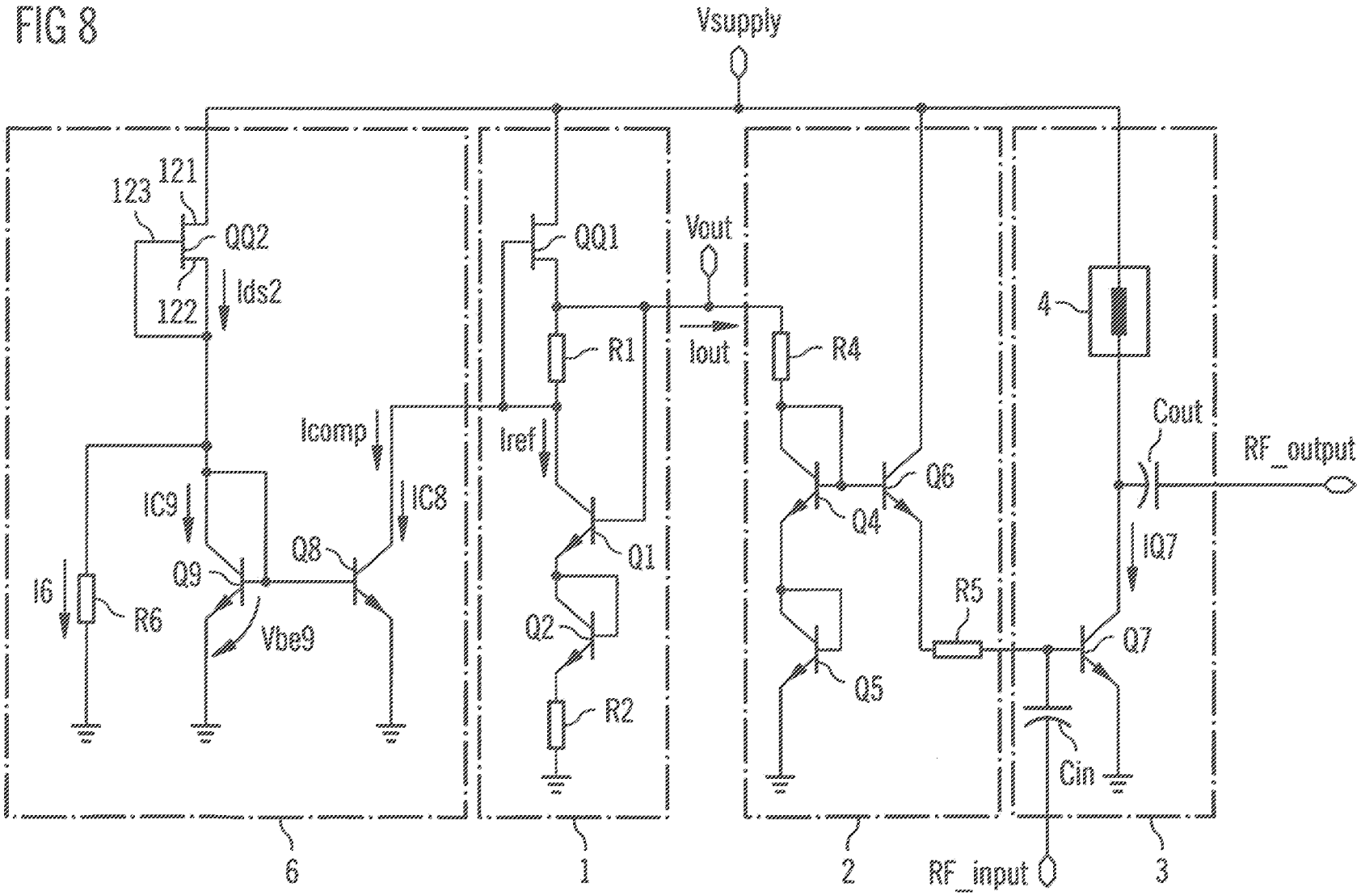
FIG. 8 shows an embodiment of an RF power amplifier circuit comprising an embodiment of the voltage regulator having another embodiment of the current sink.

FIG. 8 shows a circuit comprising an embodiment of the voltage regulator 1 with a threshold voltage variation compensation by means of a practical implementation for the current sink 6.

The current sink 6 comprises a second pHEMT QQ2 which is an embodiment of a field effect transistor having a drain terminal 121, a source terminal 122 and a gate terminal 123. The supply voltage Vsupply is applied to the drain terminal 121. The gate terminal 123 and the drain terminal 122 are connected. The current sink 6 further comprises an eighth transistor Q8, a ninth transistor Q9 and a sixth resistor R6. A collector terminal of the eighth transistor Q8 is coupled with the gate terminal of the PHEMT QQ1 and the resistor R1. The sixth resistor R6 is coupled with the emitter and collector terminals of the ninth transistor Q9. The collector and base of transistor Q9 are short-circuited and coupled with the source terminal 122 of the second pHEMT QQ2. The base terminals of the eighth and ninth transistor Q8, Q9 are connected so that they form a current mirror.

The threshold voltage variation compensation circuit 6 in FIG. 8 has a current source output which is the eight transistor Q8. Its current is a scaled copy of the current through the ninth transistor Q9, the transistors Q8 and Q9 serving as a Vbe mirror. The current Ic9 through the ninth transistor Q9 is the difference between the current Ids2 through the threshold voltage detector PHEMT2 and the reference current defined by the sixth resistor R6 and the Vbe-voltage of Q9. In equations:

$$Ids2=g_m,sat*(-VT), \quad (4)$$

$$I6=Vbe9/R6, \quad (5)$$

$$Ic9=Ids2-I6, \quad (6)$$

$$Icomp=Ic8=(I_s8/I_s9)*Ic9, \quad (7)$$

$$Icomp=I_s8/I_s9*(g_m,sat*(-VT)-Vbe9/R6). \quad (8)$$

Replacing the threshold voltage VT by its variation VT=VT0+DVT in the last equation yields:

$$Icomp=I_s8/I_s9*([g_m,sat*(-VT0)-Vbe9/R6]-[g_m,sat]*DVT). \quad (9)$$

I6 is the current through the sixth resistor R6. Ic8 is the collector current of Q8. Ic9 is the collector current of Q9. I_s8 is the saturation current of Q8. I_s9 is the saturation current of Q9. Vbe9 is the base-emitter voltage of Q9.

Equation (9) shows that with a proper choice of pHEMT QQ2 and the sixth resistor R6 a compensation current Icomp is generated that varies linearly with the threshold voltage variation DVT. In fact, the current I6 through the sixth resistor R6 is used as another reference current.

The circuit shown in FIG. 8 works very well, but also other implementations are possible for the threshold voltage compensation circuit which are suitable for generating the threshold voltage compensation current Icomp.

Figure 9A:
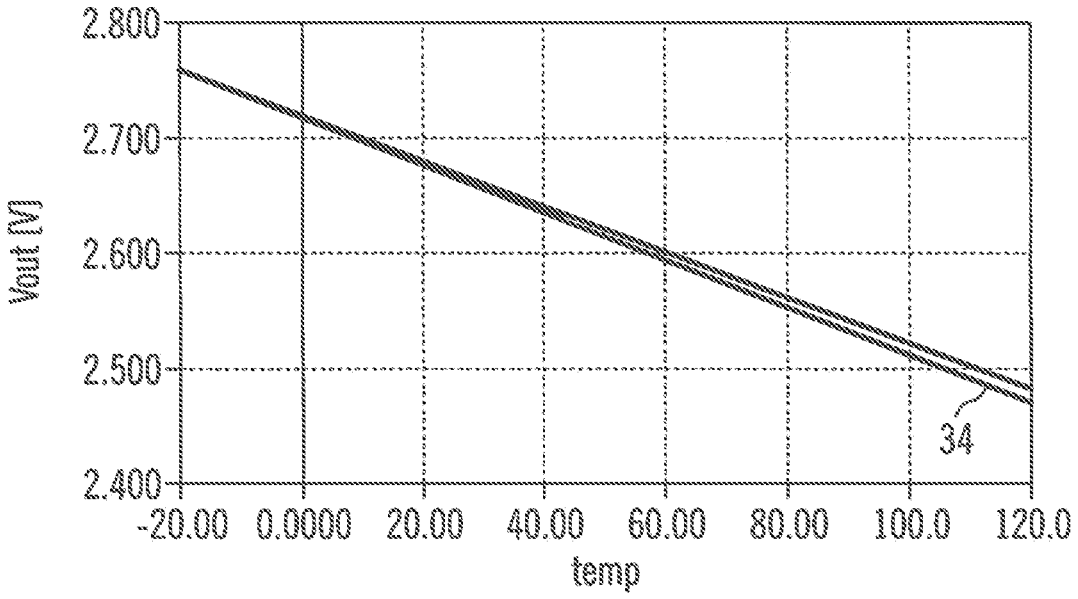
FIGS. 9A, 9B, 10A, 10B, 11A and 11B show the behavior of the circuit in FIG. 8 versus temperature, supply voltage variation and threshold voltage variation.

FIG. 9A shows the output voltage Vout of the RF power amplifier circuit shown in FIG. 8 in dependence on the temperature. A bunch of nine curves 34 shows the output voltage Vout for the supply voltages Vsupply=3.2V, 3.7V, 4.2V and the threshold voltage variations DVT=0.5V, 0V, −0.5V. The curves 34 run within a very small range.

Figure 9B:
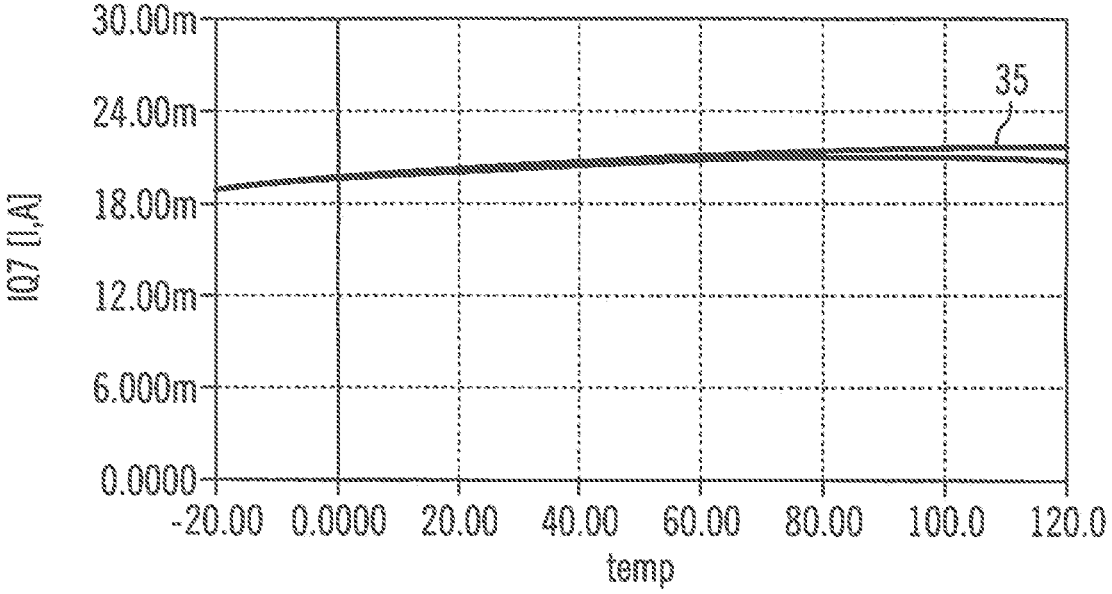

FIG. 9B shows the bias current IQ7 of the circuit shown in FIG. 8 in dependence on the temperature. A bunch of nine curves 35 shows the bias current IQ7 for the supply voltage Vsupply=3.2V, 3.7V, 4.2V and the threshold voltage variations DVT=0.5V, 0V, −0.5V. The curves 35 run within a very small range. FIGS. 9A and 9B show that the circuit shown in FIG. 8 is significantly less sensitive to threshold voltage variation than the circuit shown in FIG. 1 with the characteristics in FIGS. 4A and 4B.

Figure 10A:
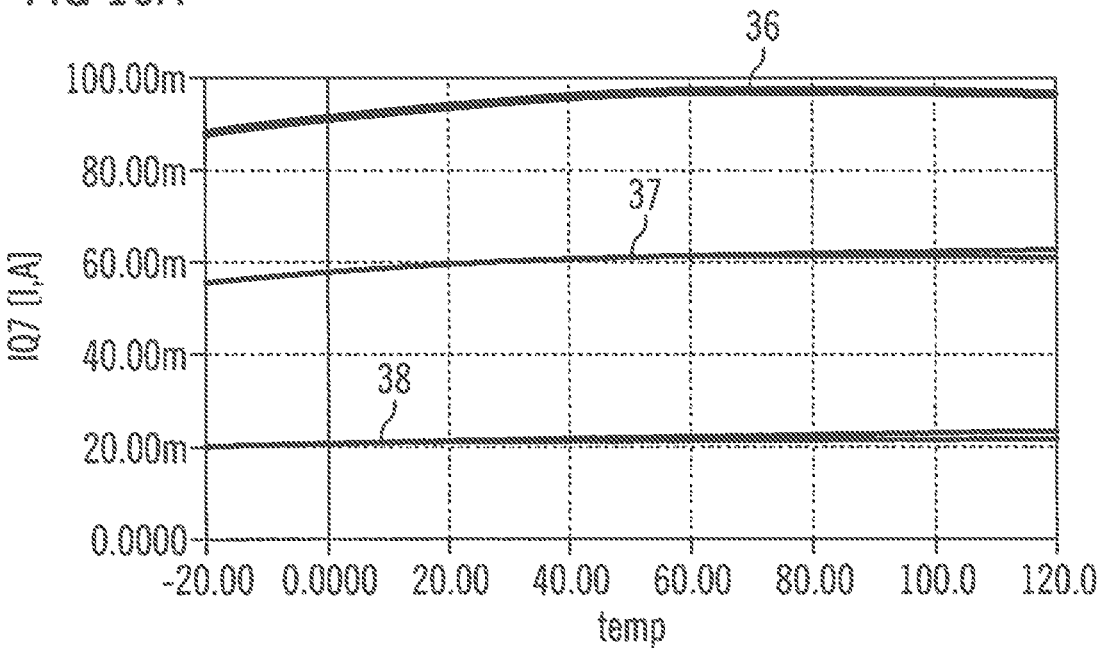

FIG. 10A shows that the compensation circuit shown in FIG. 8 works well over output voltage variation, temperature variation, as well as threshold voltage variation, when the load current Iout drawn from the voltage regulator 1 is increased by scaling the bias circuit IQ7 and the RF power stage 3 by a parameter 'factor.' A bunch of curves 38 shows the bias current IQ7 for the supply voltages Vsupply=3.2V, 3.7V, 4.2V and the threshold voltage variations DVT=0.5V, 0V, −0.5V, wherein the factor is 1. A bunch of curves 37 shows the bias current IQ7 for supply voltages Vsupply=3.2V, 3.7V, 4.2V and the threshold voltage variations DVT=0.5V, 0V, −0.5V, wherein the factor is 3. A bunch of curves 36 shows the bias current IQ7 for supply voltages Vsupply=3.2V, 3.7V, 4.2V and the threshold voltage variations DVT=0.5V, 0V, −0.5V, wherein the factor is 5. Each bunch of curves 36, 37, 38 runs within a very small range. The curves show that the threshold voltage compensation works well. The bias current IQ7 depends on the load, but it is insensitive to the threshold voltage variation.

Figure 10B:
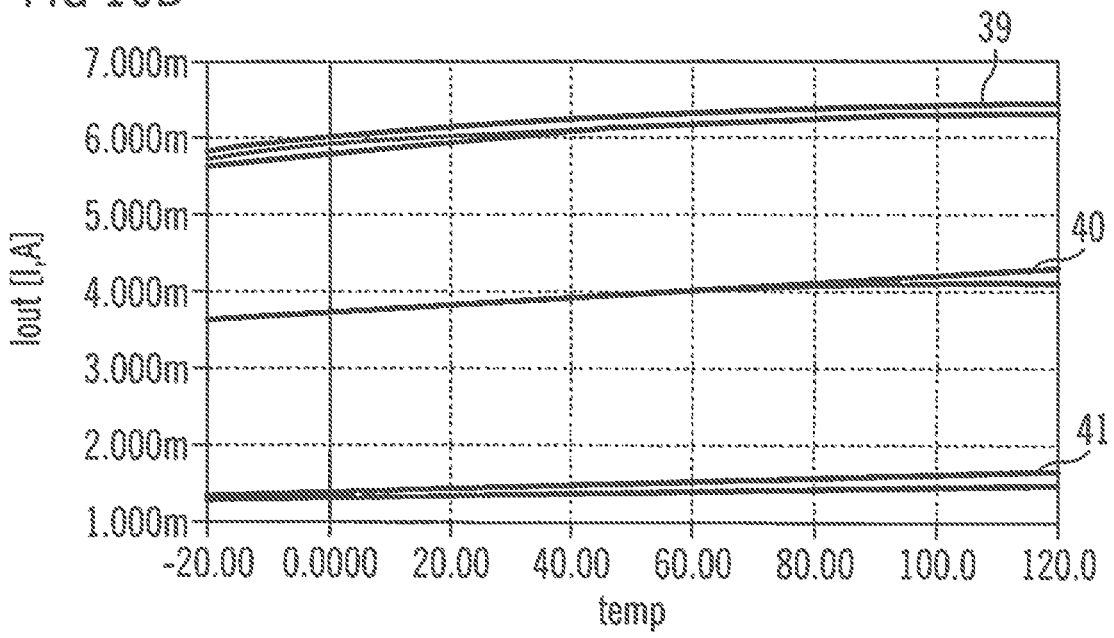

FIG. 10B shows the load current Iout drawn from the voltage regulator 1 for the same conditions as in FIG. 10A. A bunch of curves 41 shows the load current Iout for supply voltages Vsupply=3.2V, 3.7V, 4.2V and the threshold voltage variations DVT=0.5V, 0V, −0.5V, wherein the factor is 1. A bunch of curves 40 shows the load current Iout for the supply voltages Vsupply=3.2V, 3.7V, 4.2V and the threshold voltage variations DVT=0.5V, 0V, −0.5V, wherein the factor is 3. A bunch of curves 39 shows the load current Iout for the supply voltages Vsupply=3.2V, 3.7V, 4.2V and the threshold voltage variations DVT=0.5V, 0V, −0.5V, wherein the factor is 5. Each bunch of curves 39, 40, 41 runs within a very small range. The curves show that the threshold voltage compensation works well. The load current Iout depends on the load, but it is insensitive to the threshold voltage variation.

Variations of the supply voltage Vsupply, the threshold voltage and the load current Iout result in a quiescent current variation of Q7 of the RF power stage 3 of about +/−1%.

Figure 11A:
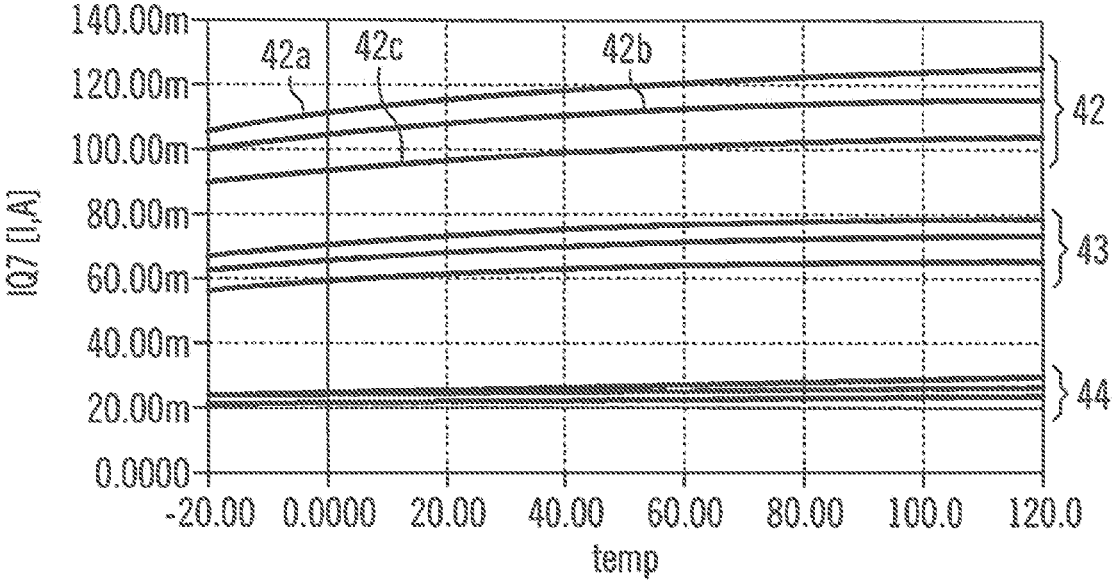
Figure 11B:
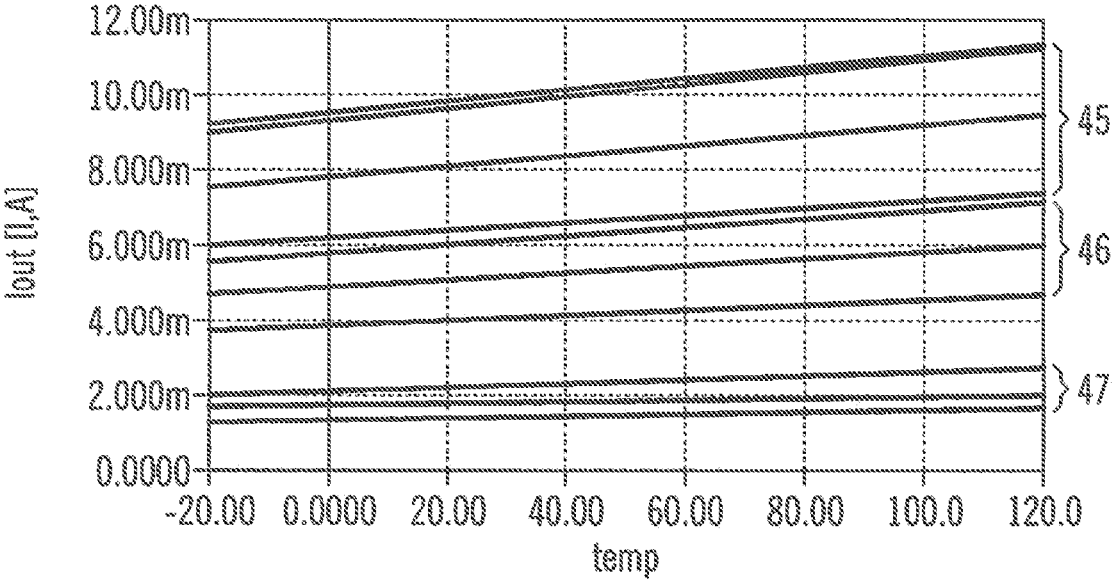

For reference, FIGS. 11A and 11B show the situation without the threshold voltage variation compensation circuit 6, which is much worse, about +/−10% variation.

FIG. 11A shows the bias current IQ7 versus the temperature. A bunch of curves 44 shows the bias current IQ7 for the supply voltages Vsupply=3.2V, 3.7V, 4.2V and the threshold voltage variations DVT=0.5V, 0V, −0.5V, wherein the factor is 1. A bunch of curves 43 shows the bias current IQ7 for the supply voltages Vsupply=3.2V, 3.7V, 4.2V and the threshold voltage variations DVT=0.5V, 0V, −0.5V, wherein the factor is 3. A bunch of curves 42 shows the bias current IQ7 for the supply voltages Vsupply=3.2V, 3.7V, 4.2V and the threshold voltage variations DVT=0.5V, 0V, −0.5V, wherein the factor is 5. Each bunch 42, 43, 44 comprises three groups of curves. A top group, e.g., 42*a*, shows the bias current IQ7 for the supply voltages Vsupply=3.2V, 3.7V, 4.2V, wherein the threshold voltage variation is DVT=−0.5V. A middle group, e.g., 42*b*, shows the bias current IQ7 for the supply voltages Vsupply=3.2V, 3.7V, 4.2V, wherein the threshold voltages variation is DVT=0V. A bottom group, e.g., 42*c*, shows the bias current IQ7 for the supply voltages Vsupply=3.2V, 3.7V, 4.2V, wherein the threshold voltages variation is DVT=0.5V.

FIG. 11B shows the load current Iout for the same conditions as in FIG. 11A. A bunch of curves 47 shows the load current Iout for the supply voltages Vsupply=3.2V, 3.7V, 4.2V and the threshold voltage variations DVT=0.5V, 0V, −0.5V, wherein the factor is 1. A bunch of curves 46 shows the load current Iout for the supply voltages Vsupply=3.2V, 3.7V, 4.2V and the threshold voltage variations DVT=0.5V, 0V, −0.5V, wherein the factor is 3. A bunch of curves 45 shows the load current Iout for the supply voltages Vsupply=3.2V, 3.7V, 4.2V and the threshold voltage variations DVT=0.5V, 0V, −0.5V, wherein the factor is 5.

Figure 12:
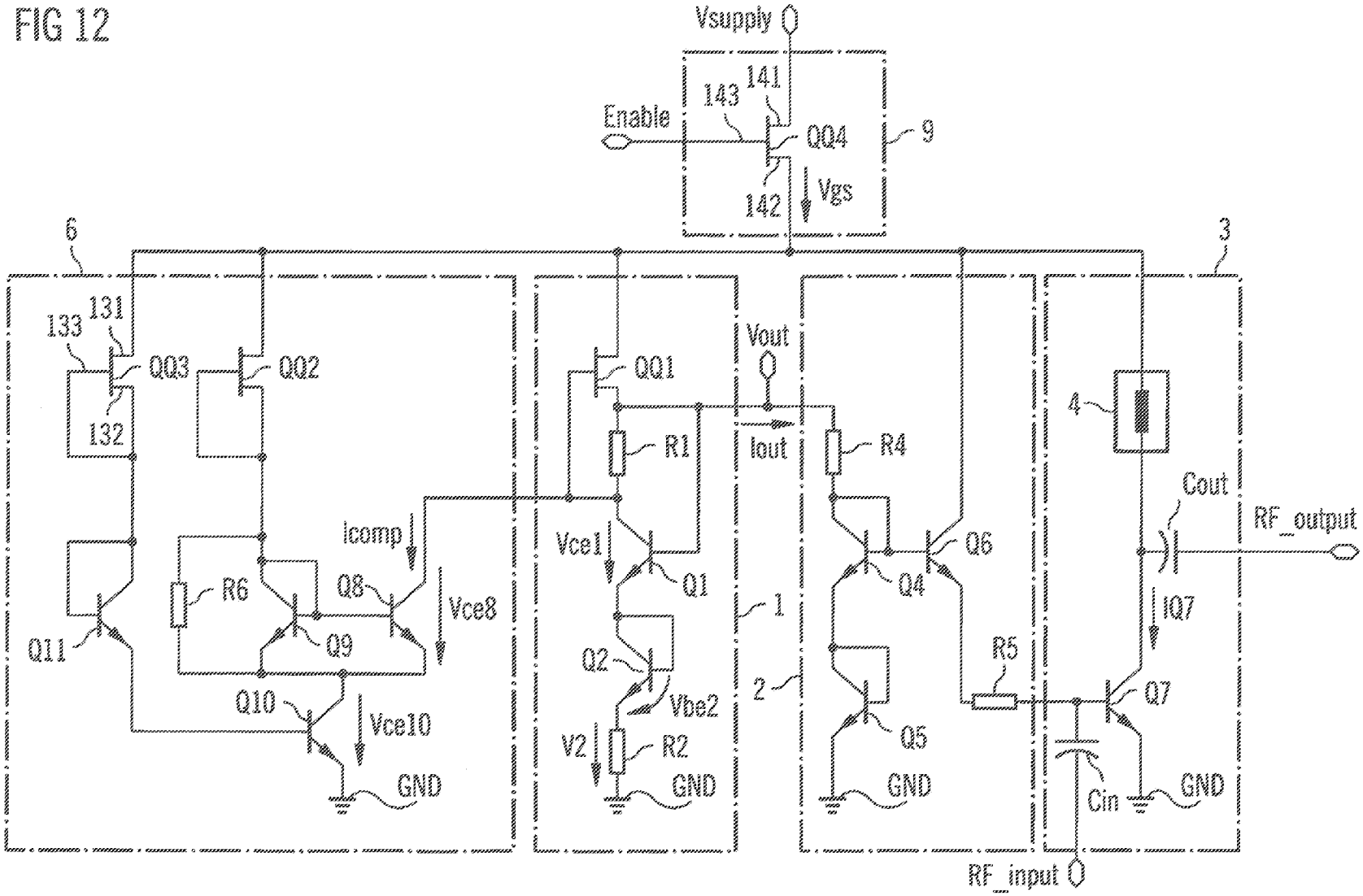
FIG. 12 shows an embodiment of an RF power amplifier circuit comprising an embodiment of an enabling module.

FIG. 12 shows a further embodiment of the RF power amplifier circuit comprising the voltage regulator 1, the bias circuit 2, the RF power stage 3 and an enabling circuit 9. FIG. 12 shows how an enable function can be added to the circuit in FIG. 8. A fourth pHEMT QQ4, a third pHEMT QQ3, a tenth transistor Q10 and an eleventh transistor Q11 are additionally provided.

The circuit has the ability to switch off the voltage regulator 1 and achieve low leakage current. The supply voltage Vsupply is applied via the fourth D-mode pHEMT switch QQ4 to the voltage regulator 1, the bias circuit 2, and the RF power stage 3, the fourth pHEMT QQ4 being controlled by an enable voltage Enable. The D-mode pHEMT QQ4 needs to have two base-emitter junctions between its source terminal 142 and the ground potential GND in order to shut off completely and achieve low "leakage" currents. Therefore the transistors Q10, Q11 are added, and the third pHEMT QQ3 which serves as current limiter is added. A drain terminal 131 of the third pHEMT QQ3 is coupled with the source terminal 142 of the fourth pHEMT QQ4. A source terminal 132 and a gate terminal 133 of the third pHEMT QQ3 are coupled with each other and with a collector and a base terminal of the eleventh transistor Q11. An emitter terminal of the eleventh transistor Q11 is coupled with a base terminal of the tenth transistor Q10, whose collector terminal is coupled with the emitter terminals of the transistors Q8, Q9 and whose emitter terminal is coupled with the reference potential GND.

The D-mode pHEMT QQ4 serves as a general enable switch for the total circuit. But to turn off the pHEMT QQ4 completely so that there is only a low leakage current it needs to have two base-emitter diodes between the source terminal 142 and GND, so that for the Enable voltage Enable=0 Vgs=0-2*Vbe≈−1.5 to −2V of the pHEMT QQ4, which is far enough below the threshold voltage VT of pHEMT QQ4 which is around −1V.

There are pairs of two base-emitter diodes in the bias circuit 2 and the RF power stage 3 also: Q4 and Q5, Q6 and Q7. In the voltage provider 1 there are Q1 and Q2.

In the compensation circuit 6 which is shown in FIG. 8 only the ninth transistor Q9 is provided. Thus, the tenth transistor Q10 is added which functions as a switch, because there is sufficient voltage headroom for the voltage Vce10+Vce8 across the transistors Q10 and Q8 compared to the voltage Vce1+Vbe2+V2 across the transistors Q1, Q2 and the second resistor R2, which does not affect the performance.

The eleventh transistor Q11, a level shift, is also added to get two base-emitter diodes Q10 and Q11 between the source terminal 142 of the pHEMT QQ4 and GND. The third pHEMT QQ3, which serves as a current source, is added to limit the base current of the tenth transistor Q10.

It should be mentioned that in off-state, the transistors Q10 and Q11 are off (only leakage current), and the threshold voltage compensation circuit is switched off.

In the off-state the improved voltage regulator 1 shown in FIG. 12 has a lower "leakage" current I_leakage compared to a conventional circuit, e.g., shown in U.S. Patent Publication No. 2007/0159145 (approximately one order of magnitude). In off-state pHEMT QQ4 has a gate-source voltage that is nearly equal to the threshold voltage, Vgs≈VT. The voltages over the resistors are negligibly small, and so:

$$I_leakage = I_s1,2*\exp((VT_4/2)/(kT/q)),$$

wherein I_s1,2 is the saturation current of Q1, Q2. VT_4 is the threshold voltage of the pHEMT QQ4.

The leakage current in the worst case situation for the circuit shown in FIG. 12 is about 100 nA compared to about 1100 nA for the conventional circuit, in which the level-shift is formed in the base of the transistor Q1, so that the diode current is lower and therefore the diode voltage is lower. Consequently, for the same Vgs≈VT for QQ4 in off-state, Vbe of the first transistor Q1 is slightly higher as well as the collector current of Q1 which results in a larger "leakage" current.

The term "comprising" is intended to specify the presence of stated features, means, steps, or components, but does not exclude the presence or addition of one or more other features, means, steps, components, or groups thereof. Further, the word "a" or "an" preceding an element does not exclude the presence of a plurality of such elements. Furthermore, it is to be noted that "coupled" is to be understood that there is a current path between those elements that are coupled, i.e., "coupled" does not mean that those elements must be directly connected. However, the elements can be connected directly, in particular if shown so in the figures.

Further, it should be mentioned that the features of the embodiments can be combined.

The invention claimed is:

1. A voltage regulator for providing a regulated output voltage, the voltage regulator comprising:

a regulating module comprising a resistor and a pHEMT that has a threshold voltage, the resistor being coupled to a gate terminal and a source terminal of the pHEMT, wherein the regulating module provides the output voltage;

a reference module configured to detect a variation of the output voltage, the reference module being coupled to the regulating module; and a current sink configured to subtract a compensation current from a current flowing from the regulating module to the reference module, the compensation current being dependent on a variation of the threshold voltage, wherein the current sink comprises:

a reference pHEMT that is configured to detect the threshold voltage, the reference pHEMT comprising a drain terminal, a source terminal, and a gate terminal, the drain terminal being connected to the drain terminal of the pHEMT of the regulating module, and the gate terminal and the source terminal being connected to each other;

a resistor that is configured to generate a reference current; and a current mirror comprising a first current mirror transistor and a second current mirror transistor, wherein a collector terminal of the first current mirror transistor is coupled with the gate terminal of the pHEMT of the regulating module and the resistor of the regulating module, wherein an emitter terminal and a collector terminal of the second current mirror transistor are coupled with the resistor of the current mirror, and wherein a base terminal and the collector terminal of the second current mirror transistor are short circuited and coupled with the source terminal of the reference pHEMT.

2. The voltage regulator according to claim 1, wherein the regulating module is configured to regulate a current flowing through the resistor.

3. The voltage regulator according to claim 1, wherein the reference module and the current sink are configured to enable a reference current through the reference module to change in response to the variation of the output voltage.

4. The voltage regulator according to claim 1, wherein the reference module comprises a transistor having a base terminal to which the output voltage is applied.

5. The voltage regulator according to claim 1, wherein the current sink is configured to generate the compensation current, which can vary within a range from zero or nearly zero to a maximum current value.

6. The voltage regulator according to claim 1, wherein the voltage regulator is coupled to an enabling module configured to activate the voltage regulator, the enabling module being coupled between the voltage regulator and a supply voltage terminal.

7. The voltage regulator according to claim 6, wherein the enabling module is configured to switch with low leakage current.

8. The voltage regulator according to claim 7, wherein the current sink comprises a transistor that serves as a switch.

9. A system comprising:

the voltage regulator according to claim 1; and a bias circuit that comprises a plurality of series connections, each series connection comprising a resistor and a switch, wherein the series connections are connected in parallel.

10. A method for reducing an influence of a threshold voltage variation of a pHEMT, the method comprising:

adjusting, by a regulating module, a voltage drop over a resistor, the regulating module comprising the resistor and the pHEMT, the resistor being coupled to a gate terminal and a source terminal of the pHEMT;

detecting, by a reference module, a variation of an output voltage of the regulating module, the reference module being coupled to the regulating module;

subtracting, by a current sink, a compensation current from a current flowing from the regulating module to the reference module, the compensation current being dependent on the variation of the threshold voltage, wherein the current sink comprises:

a reference pHEMT that is configured to detect the threshold voltage, the reference pHEMT comprising a drain terminal, a source terminal, and a gate terminal, the drain terminal being connected to the drain terminal of the pHEMT of the regulating module, and the gate terminal and the source terminal being connected to each other;

a resistor that is configured to generate a reference current; and a current mirror comprising a first current mirror transistor and a second current mirror transistor, wherein a collector terminal of the first current mirror transistor is coupled with the gate terminal of the pHEMT of the regulating module and the resistor of the regulating module, wherein an emitter terminal and a collector terminal of the second current mirror transistor are coupled with the resistor of the current mirror, and wherein a base terminal and the collector terminal of the second current mirror transistor are short circuited and coupled with the source terminal of the reference pHEMT.

11. The method according to claim 10, wherein adjusting the voltage drop comprises adjusting a current flowing through the resistor.

12. The method according to claim 11, further comprising generating the compensation current that is dependent on a variation of the threshold voltage so that subtracting the compensation current from the current yields a regulated reference current.

* * * * *